US006010313A

United States Patent [19]

Kimura et al.

[11] Patent Number: 6,010,313

[45] Date of Patent: Jan. 4, 2000

[54] SINGLE-HEADED PISTON TYPE COMPRESSOR

[75] Inventors: Kazuya Kimura; Hiroaki Kayukawa; Masaki Ota, all of Kariya, Japan

[73] Assignee: Kabushiki Kaisha Toyoda Jidoshokki Seisakusho, Aichi-ken, Japan

[21] Appl. No.: 08/985,735

[22] Filed: Dec. 5, 1997

[30] Foreign Application Priority Data

Dec. 9, 1996 [JP] Japan ..... 8-328605

[51] Int. Cl.[7] ..... F04B 1/26

[52] U.S. Cl. ..... 417/222.2; 417/269; 92/71; 91/499

[58] Field of Search ..... 417/222.1, 222.2; 92/165 R, 165 PR, 71

[56] References Cited

U.S. PATENT DOCUMENTS

| | | | |
|---|---|---|---|
| 4,360,321 | 11/1982 | Copp, Jr. et al. | 417/269 |
| 5,143,348 | 9/1992 | Baker et al. | 251/158 |
| 5,490,767 | 2/1996 | Kanou et al. | 417/222.1 |
| 5,615,599 | 4/1997 | Terauchi | 92/165 R |
| 5,868,556 | 2/1999 | Umemura | 92/71 |
| 5,934,172 | 8/1999 | Terauchi | 92/71 |

FOREIGN PATENT DOCUMENTS

| | | | |
|---|---|---|---|
| 0698735 | 2/1996 | European Pat. Off. . | |
| 3-141876 | 6/1991 | Japan . | |
| 08177733 | 7/1996 | Japan | 92/71 |
| 08254180 | 10/1996 | Japan . | |

*Primary Examiner*—Timothy S. Thorpe
*Assistant Examiner*—Cheryl J. Tyler
*Attorney, Agent, or Firm*—Morgan & Finnegan, L.L.P.

[57] ABSTRACT

A compressor includes pistons slidably accommodated in cylinder bores. A head and a skirt are formed at the ends of the piston. The head has a peripheral surface that always contacts the inner surface of the cylinder bore. The skirt is coupled with a swash plate. An annular space opens to the side of the piston. The annular space is located between the head and the skirt. A recess is located on the inner wall of a front housing and extends longitudinally in the axial direction of the piston. A projection is integrally formed on the skirt of the piston to engage with the recess. Rotation of the piston about its axis with respect to the cylinder bore is restricted by the engagement of the projection with the recess. A force acting on the piston in a direction transverse to the axis of the piston is received by the recess through the projection.

20 Claims, 3 Drawing Sheets

SINGLE-HEADED PISTON TYPE COMPRESSOR

BACKGROUND OF THE INVENTION

The present invention relates to piston type compressors that convert the rotation of drive shafts to linear reciprocation of pistons by means of drive bodies such as swash plates.

A typical piston type compressor includes a crank chamber that is defined in a housing. A drive shaft is rotatably supported in the housing. Part of the housing is constituted by a cylinder block. A plurality of cylinder bores extend through the cylinder block. Each cylinder bore accommodates a piston. A swash plate is fitted to the drive shaft in the crank chamber and supported so as to rotate integrally with the drive shaft. A pair of shoes are provided for each piston to couple the piston with the peripheral portion of the swash plate. The swash plate converts the rotation of the drive shaft to linear reciprocation of the pistons. The reciprocation of the pistons compresses refrigerant gas.

Each pair of shoes holds the swash plate in between. Each shoe is received by a shoe seat in the associated piston. The shoes are slidable with respect to the swash plate and the associated pistons. Thus, each piston is rotatable about its axis in the associated cylinder bore. Rotation of the piston causes the piston to hit the swash plate. This produces vibrations and noise.

During operation of the compressor, a moment is applied to each piston. The moment acts in a lateral direction (a direction transverse to the axis of the piston). Rotation of the swash plate slides the shoes in the associated shoe seat of each piston. The sliding produces a lateral moment that tends to tilt the piston. Thus, part of the piston is strongly pressed against the wall of the associated cylinder bore. This obstructs smooth reciprocation of the piston and causes biased wear in the cylinder bore, especially at the location that is pressed by the piston. As a result, the seal between the piston and the cylinder bore becomes less effective over time.

Japanese Unexamined Patent Publication No. 8-61237 describes a compressor that solves this problem. In this compressor, a pair of arms project from the crank chamber end of each piston in a direction substantially perpendicular to the axis of the piston. A groove is defined in the distal end of each arm. A guide rod extends in the axial direction of the pistons between each pair of adjacent cylinder bores. Each guide rod is slidably held between a pair of adjacent arms extending from the associated pair of adjacent pistons. This structure restricts the rotation of each piston. Furthermore, lateral forces applied to each piston are transmitted through the arms and are received by the guide rods to prevent tilting of the piston.

However, the guide rods, which are employed to restrict rotation of the pistons, increase the number of components and assembly steps. This increases the production cost of the compressor. Japanese Unexamined Utility Model Publication No. 6-25573 describes a compressor that eliminates the need for such guide rods. In this compressor, bolts, which are used to fasten together housing elements, are extended between each adjacent pair of pistons to function as the guide rods. In this publication, it is only mentioned that the rotation of each piston is restricted by the engagement between the bolts and the arms of the piston. However, in the same manner as the previous publication, it is believed that the lateral moment applied to each piston is received by the bolt via the arms.

When inserting the bolts through the housing elements to assemble the housing, the thread at the distal ends of each bolt pass by the associated piston. Thus, the thread may contact and damage the piston. Damage to the piston affects the performance of the compressor. Furthermore, chips may be cut off when the piston is damaged by the bolt thread. If such chips remain in the housing, the chips may be caught between components and adversely affect the performance of the compressor.

Furthermore, when inserting each bolt through the housing elements, the bolt passes through the opposed grooves of adjacent piston arms. Thus, the bolt thread may damage the arm grooves. Damage to the arm grooves affects the dimensional accuracy at the engagement portion between the arm groove and the bolt. As a result, the rotation of the pistons in their cylinder bores and the lateral moment applied to each piston causes the bolts to be hit against the walls of the arm grooves. This produces noise.

SUMMARY OF THE INVENTION

Accordingly, it is an objective of the present invention to provide a piston type compressor having an improved structure for restricting the rotation and tilting of its pistons.

To achieve the above objective, the compressor according to the present invention includes a piston, a housing having a crank chamber and a cylinder bore for accommodating the piston, the housing having a wall for defining the crank chamber, the cylinder bore being defined by a surface slidably supporting the piston, and a driving device located in the crank chamber and supported on a drive shaft. The driving device is operably connected to the piston by a joint to convert rotation of the drive shaft to reciprocation of the piston. A head is formed at a first end of the piston for compressing gas supplied to the cylinder bore. The head has a peripheral surface that always contacts the surface of the cylinder bore to seal between the head and the surface of the cylinder bore. A skirt is formed at a second end of the piston, which is opposite to the first end. The skirt is placed in the crank chamber and is coupled with the driving device. An annular space opens to the side of the piston. The annular space is located between the head and the skirt. A restrictor is provided between the skirt and the wall of the housing. The restrictor restricts rotation of the piston about its axis with respect to the cylinder bore. The restrictor receives a force from the piston in a direction transverse to the axis of the piston.

Other aspects and advantages of the invention will become apparent from the following description taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a single-headed piston type compressor according to the present invention will now be described with reference to FIGS. 1 to 4. The compressor has a variable displacement and is employed in an air-conditioning system of an automobile.

Figure 1:
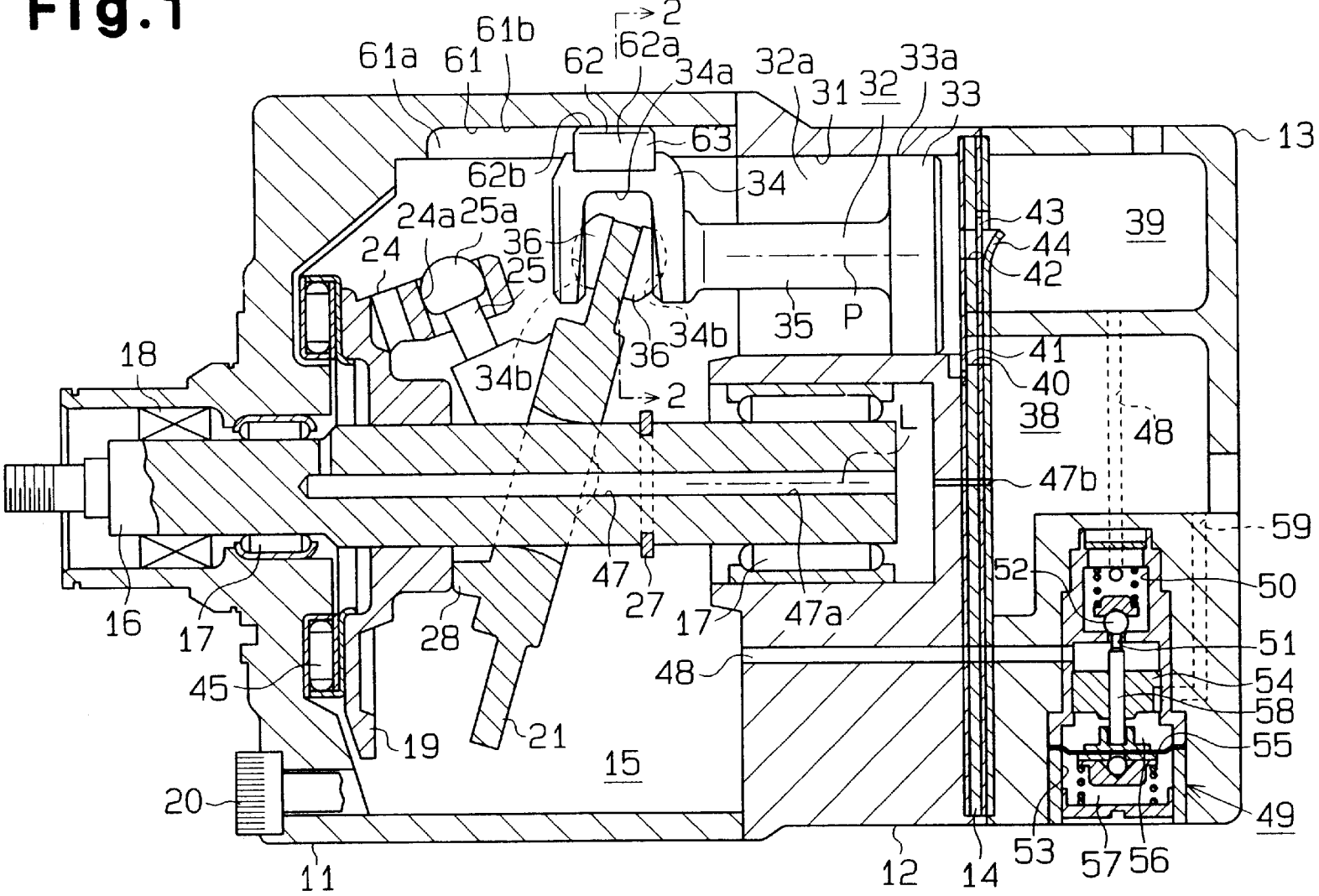
FIG. 1 is a cross-sectional view showing a first embodiment of a piston type compressor according to the present invention.

As shown in FIG. 1, a front housing 11 is coupled to the front end of a cylinder block 12. A rear housing 13 is coupled to the rear end of the cylinder block 12 with a valve plate 14 arranged in between. A crank chamber 15 is defined in the front housing 11 in front of the cylinder block 12. The front housing 11, the cylinder block 12, and the rear housing 13 constitute a housing of the compressor.

A drive shaft 16 extends through the crank chamber 15 between the front housing 11 and the cylinder block 12. A pair of radial bearings 17 rotatably support the drive shaft 16. The drive shaft 16 is operably connected to an automotive engine (not shown), which serves as an external drive source, by a clutch mechanism such as an electromagnetic clutch. Therefore, when the engine is running, engagement of the electromagnetic clutch causes the engine to rotate the drive shaft 16.

A lip seal 18 is arranged between the front end of the drive shaft 16 and the front housing 11 to prevent refrigerant gas from leaking out of the crank chamber 15.

A rotor 19 is fixed to the drive shaft 16 in the crank chamber 15. A swash plate 21 is fitted to the drive shaft 16 in the crank chamber 15. The swash plate 21 is supported so that it is slidable along and inclinable with respect to the axis L of the drive shaft 16. A pair of arms 24 (only one shown) project from the rear surface of the rotor 19. Each arm 24 has a guide hole 24*a*. The swash plate 21 has a pair of guide pins 25 (only one shown) projecting from the front surface of the swash plate 21. A guide sphere 25*a* is provided at the distal end of each guide pin 25 and slidably fitted into the guide hole 24*a* of the opposing arm 24.

The cooperation between the support arms 24 and the guide spheres 25*a* guides the movement of the swash plate 21 along the axis L of the drive shaft 16 and the inclination of the swash plate 21 with respect to the drive shaft 16. The cooperation also rotates the swash plate 21 integrally with the drive shaft 16. As the swash plate 21 moves toward the rear (toward the cylinder block 12), the inclination of the swash plate 21 with respect to a plane perpendicular to the axis L of the drive shaft 16 decreases.

An annular stopper 27 is fitted on the drive shaft 16 near the cylinder block 12. The minimum inclination position of the swash plate 21 is determined and restricted by the abutment of the swash plate 21 against the stopper 27. A protrusion 28 protrudes integrally from the front surface of the swash plate 21. The maximum inclination position of the swash plate 21 is determined and restricted by the abutment of the protrusion 28 against the rotor 19.

Cylinder bores 31 (only one shown) extend through the cylinder block 12 about the drive shaft 16. A single-headed piston 32 is accommodated in each cylinder bore 31. Each piston 32 includes a head 33, which is retained in the associated cylinder bore 31, a piston rod 35, which extends toward the crank chamber 15 from the head 33, and a skirt 34, which is connected with the piston rod 35. An annular space 32*a* is provided about the piston rod 35, which extends along the axis P of the piston 32. Therefore, in the piston 32, only the peripheral surface 33*a* of the head 33 contacts the wall of the associated cylinder bore 31.

The skirt 34 includes a slot 34*a* facing the swash plate 21. A concave shoe seat 34*b* is defined in each of the opposing walls of the slot 34*a*. Each shoe seat 34*b* slidably receives the semispherical portion of a shoe 36. The periphery of the swash plate 21 is fitted into the slot 34*a* of each piston 32 and slidably held between the flat portions of the associated pair of shoes 36. The rotation of the drive shaft 16 is converted to linear reciprocation of the pistons 32 by means of the swash plate 21 and the shoes 36.

A suction chamber 38 and a discharge chamber 39 are defined in the rear housing 13. In the valve plate 14, a suction port 40, a suction flap 41, a discharge port 42, and a discharge flap 43 are provided for each cylinder bore 31. When each piston 32 is moved from its top dead center position to its bottom dead center position during the suction stroke, the refrigerant gas in the suction chamber 38 is drawn into the associated suction port 40. The refrigerant gas then opens the suction flap 41 and enters the cylinder bore 31. When each piston 32 is moved from the bottom dead center position to the top dead center position during the compression stroke, the refrigerant gas in the cylinder bore 31 is compressed. The compressed gas enters the associated discharge port 42 and opens the discharge flap 43 to be discharged into the discharge chamber 39. The opening of each discharge flap 43 is restricted by a retainer 44 located between the valve plate 14 and the rear housing 13.

A thrust bearing 45 is arranged between the rotor 19 and the front wall of the front housing 11. The front housing 11 receives the reaction force that acts on each piston 32 during compression of the gas by way of the swash plate 21, the rotor 19, and the thrust bearing 45.

A pressure releasing passage 47 connects the crank chamber 15 with the suction chamber 38. The pressure releasing passage 47 includes a conduit 47*a*, which extends through the center of the drive shaft 16, and an aperture 47*b*, which extends through the center of the cylinder block 12 and the valve plate 14. A pressurizing passage 48 extends through the cylinder block 12, the valve plate 14, and the rear housing 13 to connect the discharge chamber 39 with the crank chamber 15. A control valve 49 is installed in the rear housing 13 to regulate the pressurizing passage 48.

The control valve 49 has a valve chamber 50 located in the pressurizing passage 48. A valve hole 51 is connected with the valve chamber 50. A valve body 52, which moves toward and away from the valve hole 51 is arranged in the valve chamber 50. A diaphragm compartment 53 is defined in correspondence with the valve chamber 50 by a rod guide 54. A diaphragm 55 partitions the diaphragm compartment 53 into a pressure sensing chamber 56 and an atmospheric chamber 57, which is communicated with the atmosphere. A rod 58 is slidably guided by the rod guide 54. The rod 58 connects the valve body 52 and the diaphragm 55. A pressure communicating passage 59 connects the suction chamber 38 and the pressure sensing chamber 56. The refrigerant gas in the suction chamber 38 communicates with the pressure sensing chamber 56 through the communicating passage 59. The diaphragm 55 moves the valve body 52 in accordance with the pressure of the suction chamber 38 (suction pressure) communicated to the pressure sensing chamber 56. This adjusts the area of the valve hole 51 opened by the valve body 52, or the opened area of the pressurizing passage 48.

The amount of refrigerant gas that flows into the crank chamber 15 from the discharge chamber 39 by way of the pressurizing passage 48 is regulated by the control valve 49. This adjusts the pressure in the crank chamber 15. Changes in the pressure of the crank chamber 15 alter the difference between the pressure of the crank chamber 15, which acts on the rear side of the pistons 32 (toward the left in FIG. 1), and the pressure in the cylinder bores 31, which acts on the front side of the pistons 32 (toward the right in FIG. 1). The inclination of the swash plate 21 is altered in accordance with this pressure difference. Adjustment of the inclination of the swash plate 21 alters the stroke of the pistons 32 and adjusts the compressor displacement.

When a large cooling load is applied to the compressor, the high pressure in the suction chamber 38 acts on the diaphragm 55 and causes the valve body 52 to decrease the opened area of the valve hole 51. This decreases the amount of high pressure refrigerant gas supplied to the crank chamber 15 from the discharge chamber 39. The refrigerant gas in the crank chamber 15 flows toward the suction chamber 38 through the pressure releasing passage 47. This decreases the pressure of the crank chamber 15 and increases the inclination of the swash plate 19. Thus, the stroke of the pistons 32 is extended. As a result, the compressor displacement becomes large.

As the cooling load applied to the compressor becomes smaller, the pressure in the suction chamber 38 decreases. This causes the valve body 52 to increase the area of the valve hole 51 opened by the valve body 52. More high pressure refrigerant gas in the discharge chamber 39 is thus sent to the crank chamber 15 through the pressurizing passage 48. This increases the pressure of the crank chamber 15 and decreases the inclination of the swash plate 21. Hence, the stroke of the pistons 32 is shortened. In this manner, the control valve 49 alters the inclination of the swash plate 21 and controls the compressor displacement to maintain the suction pressure at a predetermined value.

The structure for restricting the rotation and tilting of each piston 32, will now be described.

Figure 2:
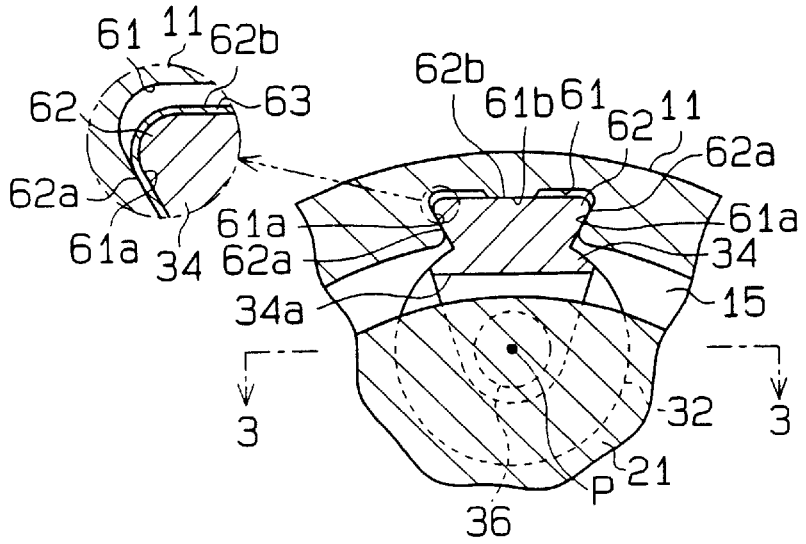
FIG. 2 is a cross-sectional view taken along line 2—2 in FIG. 1.

As shown in FIGS. 1 and 2, a dovetail keyway 61 is provided in the inner wall of the front housing 11 for each piston 32. Each keyway 61 extends along the range of movement of the skirt 34 of the associated piston 32 in the axial direction of the piston 32. A dovetail key 62 formed integrally with the skirt 34 of each piston 32 faces the wall of the front housing 11. The key 62 is fitted into the associated keyway 61 when the piston is located in the associated cylinder bore 31. Accordingly, the key 62 is guided in the keyway 61 during reciprocation of the piston 32.

In each keyway 61, each of the two side surfaces is a lateral receiving surface 61*a*. The distance between the lateral receiving surfaces 61*a* becomes more narrow toward the opening of the keyway 61. A lateral contact surface 62*a* is provided on each side of the key 62. Each lateral contact surface 62*a* is parallel to the corresponding lateral receiving surface 61*a*. When the key 62 is fitted into the associated keyway 61, each lateral contact surface 62*a* contacts the corresponding lateral receiving surfaces 61*a*.

A central receiving surface 61*b* extends along the bottom middle surface of the keyway 61. A central contact surface 62*b* is formed on the key 62 extending parallel to the central receiving surface 61*b* of the associated keyway 61. When the key 62 is fitted into the keyway 61, the central contact surface 62*b* contacts the corresponding central receiving surface 61*b*. As shown in the enlarged circle of FIG. 2, a coating 63, which is mainly polytetrafluoroethylene (PTFE), is applied to the lateral contact surfaces 62*a* and the central contact surface 62*b*.

The keyway 61 restricts the movement of each key 62. The key 62 moves only in the longitudinal direction in the keyway 61. Furthermore, the key 62 does not fall out of the keyway 61 or become loose in the keyway 61.

The shoes 36 slide with respect to the swash plate 21 and the pistons 32. This would rotate each piston 32 about its axis P. However, the contact between the lateral receiving surface 61*a* of the keyway 61 and the lateral contact surface 62*a* of the associated key 62 restricts the rotation of the piston 32. Restriction of the rotation of the piston 32 prevents the skirt 34 of the piston 32 from hitting the swash plate 21. This prevents vibrations and noise that would be caused if the skirt 34 hit the swash plate 21.

Figure 3:
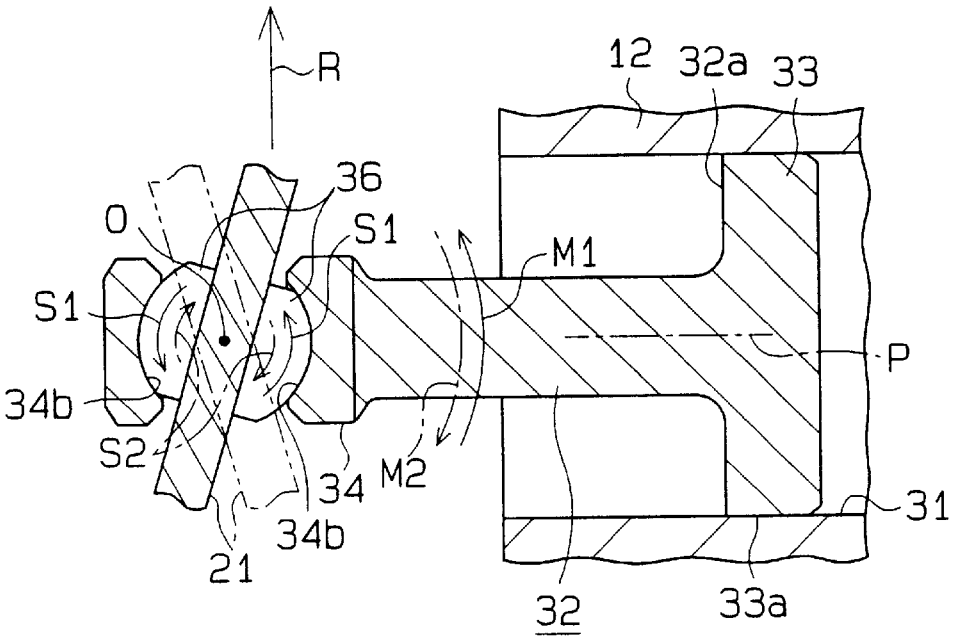
FIG. 3 is a cross-sectional view taken along line 3—3 in FIG. 2 with the piston located between its top dead center position and its bottom dead center position.

FIG. 3 shows the piston 32 located at a position between the top dead center position and the bottom dead center position. In the drawing, the direction R indicates the rotating direction of the swash plate 21. Rotation of the swash plate 21 in direction R from the state shown by the solid lines in FIG. 3 moves the piston 32 toward the bottom dead center position, or to the left as viewed in FIG. 3. As the swash plate 21 rotates, the associated pair of shoes 36, which hold the swash plate 21 in between, rotate and slide in the corresponding shoe seats 34*b*. The arrows S1 indicate the sliding direction of the shoes 36. The sliding of each shoe 36 in the associated shoe seat 34*b* produces a sliding resistance between the shoe 36 and the shoe seat 34*b*. The sliding resistance results in the application of a moment M1 on the piston 32. The moment M1 tends to tilt and pivot the piston 32 about the center point O, located between the two shoes 36. However, as shown in FIG. 2, the moment M1 applied to the piston 32 is received by the lateral receiving surface 61*a* of the keyway 61 by way of the lateral contact surface 62*a* of the key 62.

Rotation of the swash plate 21 toward direction R from the state shown by the dotted lines in FIG. 3 moves the piston 32 toward the top dead center position. The associated pair of shoes 36, which hold the swash plate 21, rotate and slide in the corresponding shoe seats 34*b*. The arrows S2 indicate the sliding direction of the shoes 36. The sliding direction S2 is opposite the sliding direction S1 of the shoes 36 when the piston 32 moves toward the bottom dead center position. As a result, a moment M2 is applied to the piston 32. The moment M2 acts in a direction opposite the moment M1. However, in the same manner as the moment M1, the moment M2 is received by the lateral receiving surface 61*a* of the keyway 61 by way of the lateral contact surface 62*a* of the key 62.

Figure 4:
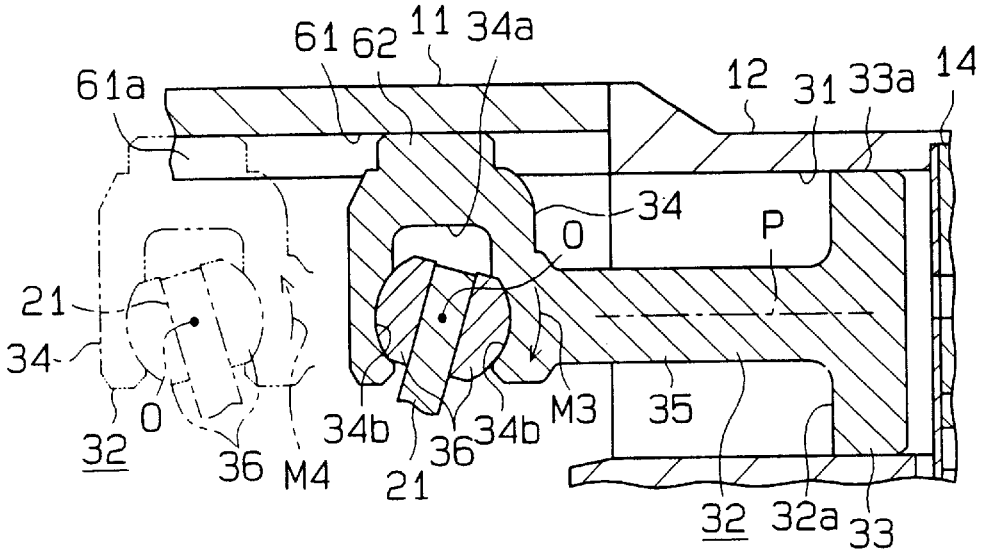
FIG. 4 is an enlarged cross-sectional view showing the piston located near the top dead center position.

When the piston 32 is located in the vicinity of the top dead center position as shown by the solid lines in FIG. 4, the compression reaction force acting on the piston 32 becomes maximal. The maximal compression reaction force is applied to the swash plate 21. Accordingly, the piston 32 receives a reaction force corresponding to the compression reaction force from the inclined swash plate 21. Part of this reaction force produces a moment M3. The moment M3 tends to tilt the skirt 34 of the piston 32 toward the axis L of the drive shaft 16. In the same manner as the moments M1 and M2, the moment M3 acts about center point O. The direction of the application of the moment M3 is offset 90 degrees from the application directions of the moments M1, M2 with respect to the axis P of the piston 32. However, the moment M3 is received by the lateral and central receiving surfaces 61*a*, 61*b* of the keyway 61 by way of the associated lateral and central contact surfaces 62*a*, 62*b* of the key 62.

When the piston 32 shifts from the suction stroke to the compression stroke and becomes located in the vicinity of the bottom dead center position, as shown by the dotted lines in FIG. 4, the inertial force acting on the piston 32 becomes maximal. The inertial force acting on the piston 32 is applied to the swash plate 21. Accordingly, the piston 32 receives a reaction force corresponding to the inertial force from the inclined swash plate 21. Part of this reaction force produces a moment M4. The moment M4 acts in a direction opposite the moment M3. However, in the same manner as the moment M3, the moment M4, which acts on the piston 32, is received by the lateral and central receiving surfaces 61*a*, 61*b* of the keyway 61 by way of the associated lateral and central contact surfaces 62*a*, 62*b* of the key 62.

As described above, when the piston 32 moves between the top and bottom dead center positions, the moments acting on the piston 32 in various directions are positively received by the lateral and/or central receiving surfaces 61*a*, 61*b* of the keyway 61 by way of the associated lateral and/or central contact surfaces 62*a*, 62*b* of the key 62. In other words, the net moment of these moments is positively received by the lateral and/or central receiving surfaces 61*a*, 61*b*. Accordingly, this structure prevents moments applied to the piston 32 in lateral directions (directions perpendicular to the moving direction of the piston 32) from pressing the head 33 of the piston 32 against the wall of the associated cylinder bore 31. This prevents biased wear of the piston 32 and/or the cylinder bore 31 and maintains an effective seal between the piston 32 and the cylinder bore 31.

The advantages described below are obtained from this embodiment.

The keyways 61 are defined in the wall of the front housing 11, while the corresponding keys 62, which are fitted into the keyways 61, are arranged on the skirts 34 of the pistons 32. The corresponding keyways 61 and keys 62 constitute a structure for restricting the rotation and tilting of the associated pistons 32. The structure stabilizes the reciprocating movement of the pistons 32 and improves the performance of the compressor. Therefore, the preferred and illustrated embodiment avoids the drawbacks of the compressor described in Japanese Unexamined Utility Model Publication No. 6-25573 in that the bolts 20, which are used to couple the compressor housing (front housing 11, cylinder block 12, rear housing 13) are not employed for restricting the rotation and tilting of the pistons 32. Accordingly, the bolts 20 do not pass by the pistons 32 when inserted into the housing. This prevents the threads at the distal ends of the bolts 20 from damaging the pistons 32 when assembling the housing. Since the pistons 32 are not damaged, degradation in the performance of the compressor is avoided.

The engagement between the keyways 61 in the front housing 11 and the corresponding keys 62 of the pistons 32 positively receives the laterally directed moments M1, M2, M3, and M4 acting on the pistons 32. Thus, the moments M1, M2, M3, and M4 are not received by the walls of the associated cylinder bores 31. This minimizes the area of the head 33 of each piston 32 that must contact the wall of the associated cylinder bore 31. More specifically, the axial length of the head 33 can be reduced as long as there is an effective seal between the piston 32 and the wall of the cylinder bore 31.

This structure results in annular space 32*a* formed between the head 33 and the skirt 34, which significantly decreases the weight of the piston 32. The inertial force acting on the piston 32 is thus minimized. This, in turn, decreases the magnitude of the lateral moments that result from the inertial force, which further stabilizes the reciprocating movement of the piston 32. The large inertial force applied to the piston 32 when the piston 32 is located in the vicinity of the bottom dead center position acts in a direction that increases the inclination of the swash plate 21. Thus, a smaller inertial force applied to the piston 32 decreases the influence of the inertial force on the swash plate 32 during adjustment of the swash plate inclination. Therefore, the lighter weight piston 32 employed in the preferred and illustrated embodiment stabilizes the control of the compressor displacement.

The coating 63 applied to the surface of each key 62 improves the anti-wear property of the key 62 and reduces the sliding resistance between the key 62 and the associated keyway 61. Accordingly, smooth reciprocation of the associated piston 32 is guaranteed over a long period of time.

The keyways 61 are formed in the wall of the front housing 11, while the keys 62 are formed integrally on the skirts 34 of the pistons 32. Accordingly, the structure for restricting the rotation and tilting of the pistons 32 in the preferred and illustrated embodiment does not increase the number of components in the compressor.

Figure 5:
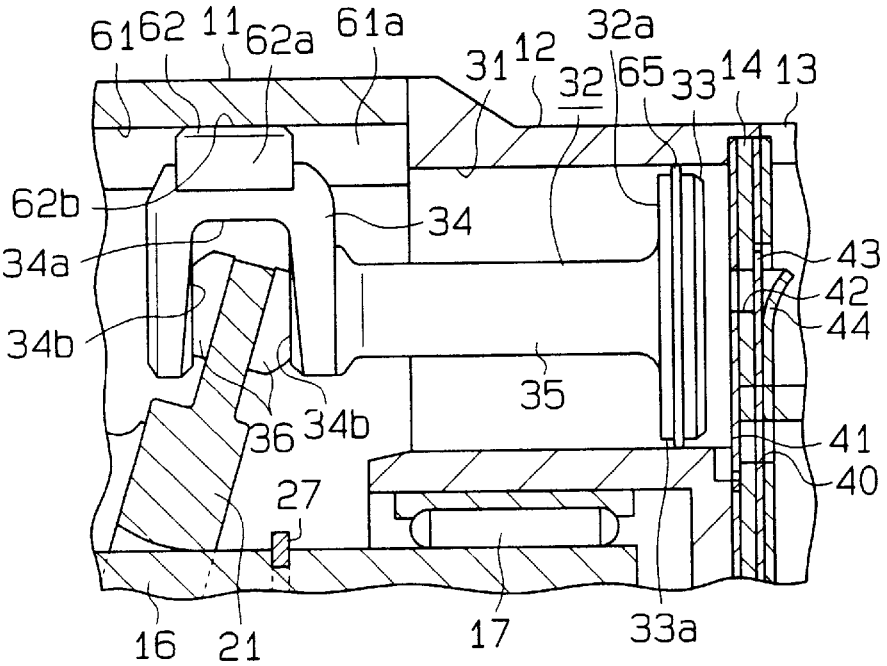
FIG. 5 is a cross-sectional view of a piston employed in a second embodiment of a piston type compressor according to the present invention.

A piston employed in a second embodiment of a compressor according to the present invention will now be described with reference to FIG. 5. Parts that are like or same as the corresponding parts in the first embodiment are denoted with the same reference numerals.

In the first embodiment, satisfactory sealing between the piston 32 and the cylinder bore 31 is guaranteed by providing a minimum axial length of the peripheral surface 33*a* of the head 33. In this embodiment, an annular piston ring 65 is fitted in an annular groove, which extends along the peripheral surface 33*a* of the head 33. The piston ring 65 is radially elastic. Thus, the piston ring 65 seals the space between the piston 32 and the cylinder bore 31 when elastically pressed against the wall of the cylinder bore 31. This enables the axial length of the peripheral surface 33*a* of the head 33 to be shortened. Accordingly, the axial length of the peripheral surface 33*a* of the head 33, which does not function as a seal, may be minimized to a dimension just long enough to retain the piston ring 65. As a result, the axial length of the head 33 is shortened in comparison with that of the first embodiment. This further decreases the weight of the piston 32.

It should be apparent to those skilled in the art that the present invention may be embodied in many other specific forms without departing from the spirit or scope of the invention. Particularly, it should be understood that the invention may be embodied in the following forms.

Each keyway 61 may be provided with only one lateral receiving surface 61*a*, and each key 62 may be provided with only one lateral contact surface 62*a*.

The keyways 61 may be formed on the skirt 34 of each piston 32 and the keys 62 may be formed on the wall of the front housing 11. This further decreases the weight of the piston 32.

The keyways 61 and/or the keys 62 may be constituted by bodies that are independent from the front housing 11 and the pistons 32.

The coating 63 may be applied to the keyways 62 instead of the keys 61. As another option, the coating 63 may be applied to both the keys 61 and the keyways 62.

The main material of the coating 63 is not limited to PTFE. For example, silicon molybdenum may be mixed with graphite to constitute the main material of the coating 63.

The application of the present invention is not limited to a single-headed piston type compressor having variable displacement. For example, the present invention may be applied to a compressor having a fixed displacement and employing a swash plate. The present invention may also be applied to a compressor that employs a so-called wave cam plate in lieu of the swash plate.

Therefore, the present examples and embodiments are to be considered as illustrative and not restrictive and the invention is not to be limited to the details given herein, but may be modified within the scope and equivalence of the appended claims.

What is claimed is:

1. A compressor including a piston, a housing having a crank chamber and a cylinder bore for accommodating the piston, the housing having a wall for defining the crank chamber, the cylinder bore being defined by a surface slidably supporting the piston, and a driving device located in the crank chamber and supported on a drive shaft, wherein the driving device is operably connected to the piston by a joint to convert rotation of the drive shaft to reciprocation of the piston, the compressor comprising:

a head formed at a first end of the piston for compressing gas supplied to the cylinder bore, wherein the head has a peripheral surface that always contacts the surface of the cylinder bore to seal between the head and the surface of the cylinder bore;

a skirt formed at a second end of the piston, which is opposite to the first end, wherein the skirt extends into the crank chamber and is coupled with the driving device;

an annular space that opens to a side of the piston, the annular space being located between the head and the skirt; and a restrictor provided between the skirt and the wall of the housing, wherein the restrictor restricts rotation of the piston about the piston axis when the restrictor receives a force from the piston in a direction transverse to the axis of the piston, the restrictor including a dovetailed member formed on the skirt and a corresponding dovetailed guide formed on the wall of the housing wherein the dovetailed member has a contact surface and the dovetailed guide has a receiving surface facing the contact surface, and wherein the receiving surface has a protrusion that extends toward the contact surface.

2. The compressor according to claim 1, wherein the dovetailed guide is a recess, and wherein the dovetailed member is a projection to slidably engage with the recess.

3. The compressor according to claim 2, wherein the recess extends longitudinally in the axial direction of the piston, wherein the projection is integral with the skirt of the piston, and wherein the recess retains the projection such that the projection can move only in the longitudinal direction of the recess.

4. The compressor according to claim 3, wherein the recess is defined by a groove having a pair of side walls opposed to each other and a bottom wall located between the side walls to serve as the receiving surface, wherein the distance between the side walls is smaller at the opening of the recess than at locations nearer to the bottom wall, and wherein the projection has a cross section corresponding to the cross section of the recess such that the projection contacts the side walls and the protrusion.

5. The compressor according to claim 2 further comprising a coating layer applied on at least one of the recess and the projection to reduce the sliding resistance between the recess and the projection.

6. The compressor according to claim 1, wherein the head of the piston includes a piston ring that always contacts the surface of the cylinder bore.

7. The compressor according to claim 1, wherein the joint includes a pair of shoes received in the skirt of the piston to slidably hold the driving device.

8. The compressor according to claim 1, wherein the protusion is located at the middle of the receiving surface, wherein a clearance is formed between the contact surface and the receiving surface on each of two opposite sides of the protrusion.

9. A compressor including a piston, a cylinder block having a cylinder bore for accommodating the piston, the cylinder bore being defined by a surface slidably supporting the piston, a front housing fixed to the cylinder block, the front housing having a wall for defining a crank chamber, and a driving device located in the crank chamber and supported on a drive shaft, wherein the driving device includes a rotor fixed on the drive shaft and a swash plate tiltably connected to the rotor, and wherein the swash plate is operably connected to the piston by a pair of shoes to convert rotation of the drive shaft to reciprocation of the piston, the compressor comprising:

a head formed at a first end of the piston for compressing gas supplied to the cylinder bore, wherein the head has a peripheral surface that always contacts the surface of the cylinder bore to seal between the head and the surface of the cylinder bore;

a skirt formed at a second end of the piston, which is opposite to the first end, wherein the skirt extends into the crank chamber and is coupled with the swash plate;

an annular space that opens to a side of the piston, the annular space being located between the head and the skirt;

a recess located in the wall of the front housing, wherein the recess has a bottom wall extending longitudinally in the axial direction of the piston; and a projection formed on the skirt of the piston to engage with the recess, wherein the projection has a contact surface facing the bottom wall of the recess, the bottom wall having a protrusion extending in the longitudinal direction of the bottom wall to contact the contact surface, wherein the projection is retained in the recess such that the projection moves only in the longitudinal direction of the recess, wherein rotation of the piston about its axis is restricted by the engagement of the projection with the recess when a force acting on the piston in a direction transverse to the axis of the piston is received by the recess through the projection.

10. The compressor according to claim 9, wherein the recess is defined by a dovetail-shaped groove having a pair of side walls opposed to each other, the bottom wall being located between the side walls, wherein the distance between the side walls is smaller at the opening of the recess than at locations nearer to the bottom wall, and wherein the projection has a dovetail-shaped cross section corresponding to the cross section of the recess such that the projection contacts the side walls and the protrusion.

11. The compressor according to claim 9, wherein the head of the piston includes a piston ring that always contacts the surface of the cylinder bore.

12. The compressor according to claim 9 further comprising a coating layer applied on at least one of the recess and the projection to reduce the sliding resistance between the recess and the projection.

13. The compressor according to claim 9, wherein the inclination of the swash plate varies in accordance with the difference between the pressure in the crank chamber and the pressure in the cylinder bore, and wherein the piston moves by a stroke based on the inclination of the swash plate to control the displacement of the compressor.

14. The compressor according to claim 9, wherein the protrusion is located at the middle of the bottom wall, wherein a clearance is formed between the contact surface and the bottom wall on each of two opposite sides of the protrusion.

15. The compressor comprising:

a housing having a crank chamber and a cylinder bore, wherein the housing has a wall for defining the crank chamber;

a piston slidably supported in the cylinder bore;

a driving device located in the crank chamber to reciprocate the piston;

a skirt located on the piston, wherein the skirt extends into the crank chamber and is coupled with the driving device;

a dovetailed member formed on the skirt; and a corresponding dovetailed guide formed on the wall of the housing to engage with the dovetailed member, wherein the dovetailed member has a contact surface and the dovetailed guide has a receiving surface facing the contact surface, and wherein the receiving surface has a protrusion for contacting the contact surface.

16. The compressor according to claim 15, wherein the dovetailed guide is a recess, and wherein the dovetailed member is a projection to slidably engage with the recess.

17. The compressor according to claim 16, wherein the recess extends longitudinally in the axial direction of the piston, wherein the projection is integral with the skirt of the piston, and wherein the recess retains the projection such that the projection can move only in the longitudinal direction of the recess.

18. The compressor according to claim 17, wherein the recess is defined by a dovetail-shaped groove having a pair of side walls opposed to each other and a bottom wall located between the side walls to serve as the receiving surface, wherein the distance between the side walls is smaller at the opening of the recess than at locations nearer to the bottom wall, and wherein the projection has a dovetail-shaped cross section corresponding to the cross section of the recess such that the projection contacts the side walls and the protrusion.

19. The compressor according to claim 16 further comprising a coating layer applied on at least one of the recess and the projection to reduce the sliding resistance between the recess and the projection.

20. The compressor according to claim 15, wherein the protrusion is located at the middle of the receiving surface, wherein a clearance is formed between the contact surface and the receiving surface on each of two opposite sides of the protrusion.

* * * * *

UNITED STATES PATENT AND TRADEMARK OFFICE

CERTIFICATE OF CORRECTION

PATENT NO. : 6,010,313
DATED : January 4, 2000
INVENTOR(S) : Kazuya Kimura et al.

It is certified that error appears in the above-identified patent and that said Letters Patent is hereby corrected as shown below:

Title page, column 1,
At "[75] Inventors:", line 2, after "Kariya," insert -- Aichi, --;

Title page, column 2,
Under "FOREIGN PATENT DOCUMENTS" change "0698735" to -- 0698735 A2 --, "3-141876" to -- 3-141876 A--, "08177733" to -- 08177733 A --, and "08254180" to -- 08254180 A --.

Signed and Sealed this

Ninth Day of October, 2001

*Attest:*

Nicholas P. Godici

*Attesting Officer*

NICHOLAS P. GODICI
*Acting Director of the United States Patent and Trademark Office*